US007438616B2

(12) United States Patent
Nanson

(10) Patent No.: US 7,438,616 B2
(45) Date of Patent: Oct. 21, 2008

(54) MOORING BUOY COVER

(76) Inventor: Rhett Nanson, 9 Thompson Ave., #1R, Bristol, RI (US) 02809

( * ) Notice: Subject to any disclaimer, the term of this patent is extended or adjusted under 35 U.S.C. 154(b) by 0 days.

(21) Appl. No.: 11/800,846

(22) Filed: May 8, 2007

(65) Prior Publication Data

US 2007/0270058 A1 Nov. 22, 2007

Related U.S. Application Data

(60) Provisional application No. 60/800,961, filed on May 17, 2006.

(51) Int. Cl.
*B63B 22/02* (2006.01)

(52) U.S. Cl. ..... 441/3

(58) Field of Classification Search ..... 441/3
See application file for complete search history.

(56) References Cited

U.S. PATENT DOCUMENTS

| | | | | |
|---|---|---|---|---|
| 3,455,159 | A * | 7/1969 | Gies, Sr. | 73/170.16 |
| 5,411,424 | A | 5/1995 | Hill | |
| 6,928,950 | B2 | 8/2005 | Trammell et al. | |
| 6,955,574 | B2 * | 10/2005 | Rogerson | 441/3 |

* cited by examiner

*Primary Examiner*—Jesús D Sotelo
(74) *Attorney, Agent, or Firm*—Slater & Michaelson

(57) ABSTRACT

A protective cover fits over assorted marine mooring buoys and protects a boat or other such vessel against impact and abrasion from the mooring buoy. The mooring buoy cover is constructed from impact and abrasion resistant materials. The cover includes a dome shaped section that is constructed of an impact resistant material and that is formed so as to fit with a top part of the mooring buoy and a collar section contiguous with the dome shaped section and extending to cover a shackle that is disposed at the top of the mooring buoy.

20 Claims, 4 Drawing Sheets

MOORING BUOY COVER

RELATED APPLICATION

Priority for this application is hereby claimed under 35 U.S.C. §119(e) to commonly owned and co-pending U.S. Provisional Patent Application No. 60/800,961 which was filed on May 17, 2006 and which is incorporated by reference herein in its entirety.

TECHNICAL FIELD

The present invention relates in general to mooring buoys and, more particularly to the protection of a boat or marine vessel from damages caused by a mooring buoy.

BACKGROUND OF THE INVENTION

As a boat is connected to a mooring buoy there are conditions where the boat can come into contact with the mooring buoy. This contact, depending on the conditions, can cause significant damage to the boat. For example, there may be damage caused by impact and abrasion between the boat and mooring buoy. It is also possible to encounter this same damage as one is attempting to dock at virtually any type of buoy.

Accordingly, it is an object of the present invention to minimize the potential damage caused by contact between the vessel and the buoy.

Another object of the present invention is to provide a mooring buoy cover that prevents damage to the vessel, that can be applied easily to the buoy and that can be fabricated relatively inexpensively.

SUMMARY OF THE INVENTION

In accordance with the present invention the buoy cover is constructed with a soft surface on a portion thereof. The buoy cover covers the basic spherical shaped buoy as well as the shackle that is used to attach the buoy to a mooring chain. The material of the cover is impact and abrasion resistant. The cover for the mooring buoy comprises a dome shaped or semi-spherical section that is constructed of an impact resistant material and that is formed so as to fit with a top part of the mooring buoy and a collar section contiguous with the dome shaped section and extending to cover a shackle that is disposed at the top of the mooring buoy.

In accordance with other aspects of the present invention the dome shaped section may be semi-spherical and the collar section is may be cylindrical; the dome shaped section may be constructed of a foam substrate covered by a harder plastic or vinyl material; the foam substrate may be a polyethylene foam material; including an annular section below the dome shaped section forming an annular band that defines the bottom edge of the cover; wherein the collar section and the annular band may be formed of a rigid or semi-rigid plastic material; wherein the plastic material may be PVC; wherein the dome shaped section may be provided in segments separated by void areas; wherein the dome shaped section may have at least one elongated slot in combination with lacing means for closing the cover about the mooring buoy; and preferably including a securing pin that extends through the collar section and shackle.

DESCRIPTION OF THE DRAWINGS

Reference is now made to a more detailed description of the invention taken in conjunction with the accompanying drawings, in which.

DETAILED DESCRIPTION

Figure 1:
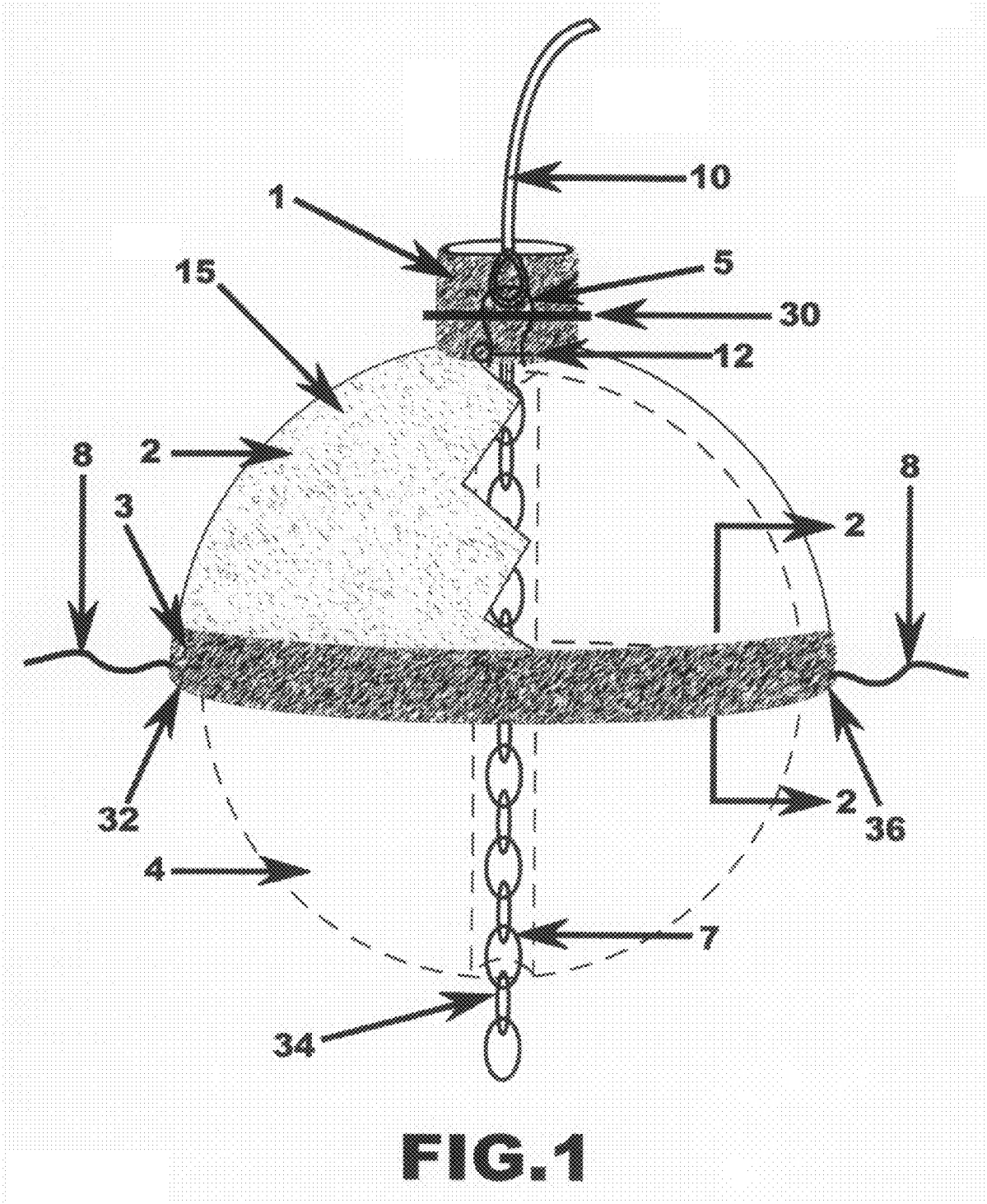
FIG. 1 schematically illustrates one embodiment of the cover of the present invention as attached to a mooring buoy.

One embodiment of the cover 2 of the present invention is shown in FIG. 1 in combination with a typical mooring buoy 4. The mooring buoy 4 is typically provided in a number of different sizes or diameters such as 18, 24 or 30 inches in diameter. The mooring buoy 4 has a central passage illustrated in FIG. 1 by dotted lines and through which the mooring chain 7 passes. The bottom of the mooring chain 7, although not shown in the drawing, typically attaches to a heavy weight anchor at the bottom of the ocean. FIG. 1 also shows the buoy in relationship to the water line at 8.

The top of the buoy may be provided with a shackle 5 that is typically of conventional design. The shackle is usually of a larger diameter than that of the passage in the ball so that the chain is prevented by its weight from falling through the ball. The shackle 5 is used for attachment to the mooring chain 7 and is also used for attaching the mooring pendant 10. The mooring pendant 10 is the line that connects to the boat that is being moored. The shackle 5 may include a screw or pin 12 that can be connected and disconnected for connecting and disconnecting the shackle with the chain and/or the pendant. There presently exist a number of different types of shackle arrangements, but in all such arrangements the shackle typically extends above the mooring ball and is a major source for causing damage should the vessel make contact with the mooring buoy. Although the drawings show the ball in an upright position because of the unstable water conditions it may well be tilted at any time causing the protruding shackle to contact the vessel being moored.

The cover 2 is constructed of an impact and moisture resistant material. The cover is placed over the top of the mooring buoy with the mooring shackle fitting inside the collar 1 but extending therefrom such as shown in FIG. 1. As is noted in the drawing, the cover itself is semi-spherical in shape and is comprised of two sections including an upper section 15 and a lower section 3. The upper section 15 is semi-spherical in shape while the lower section 3 is annular in shape. The upper section 15 is preferably constructed primarily of a polyethylene foam that resists moisture penetration and minimizes abrasion and the impact damage to the boat caused by the boat striking against the mooring buoy. The section 15 may also be constructed of other foam type materials such as EVA. The lower section 3 is typically comprised of a harder plastic material such as a PVC. This provides a more rigid surface near the water contact area with the water line 8. This is the area of the cover where marine growth may appear and by making this section of a harder plastic material on its outside it is easier to clean off the marine growth from that area of the cover.

The collar 1 is also preferably constructed of the same material as the lower section 3. The collar 1 is a smaller diameter cylindrical section at the very apex of the semi-spherical portion of the cover. All of sections 1, 3 and 15 are preferably integrally formed, although some of the parts thereof may be separately fabricated and then fixed together.

Figure 2:
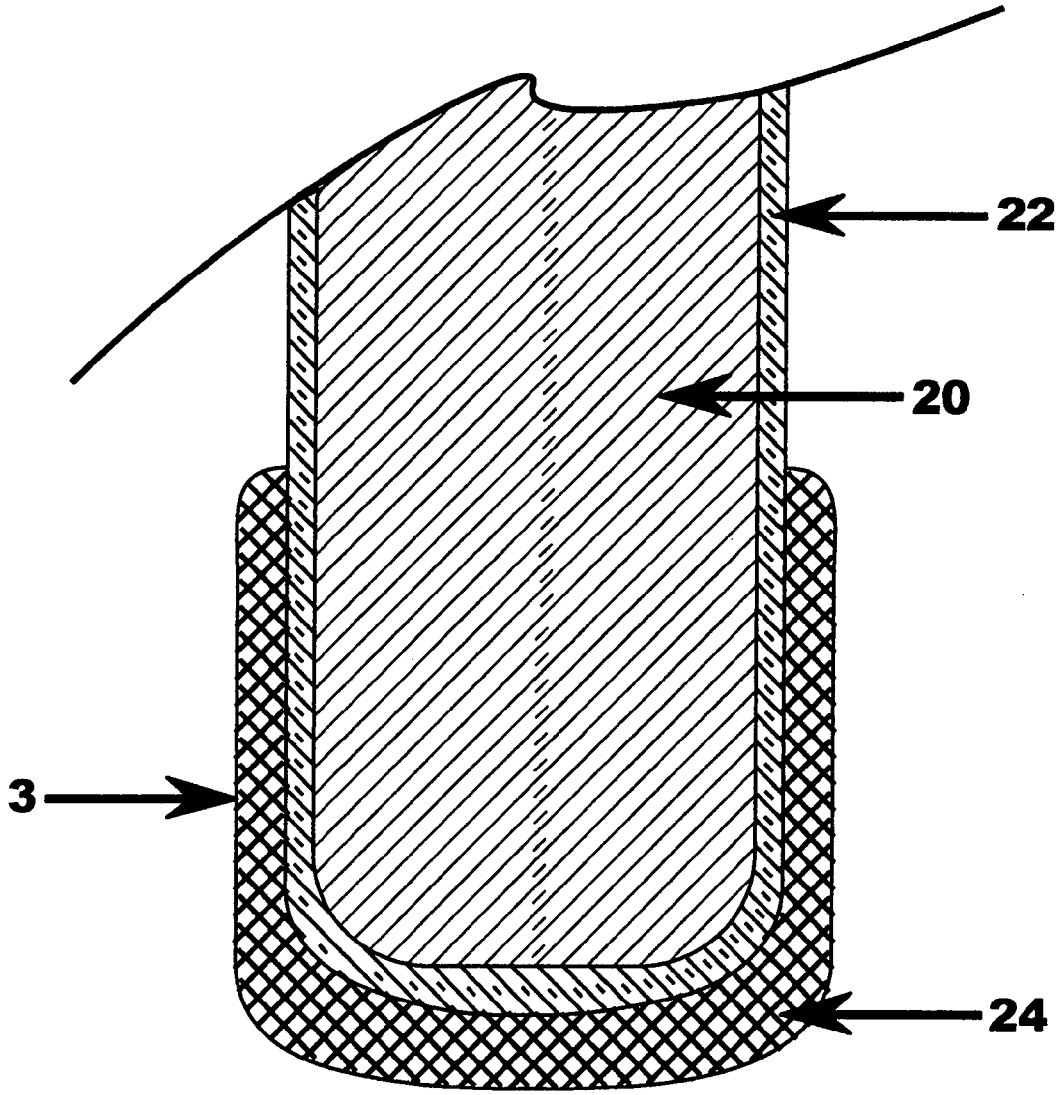
FIG. 2 is a cross-sectional view showing further details of the cover taken along line 2-2 of FIG. 1.

Reference is now made to FIG. 2 for a preferred cross-section that may apply to either the section 3 or the collar 1 of the cover. This includes a softer center core foam 20 that may be surrounded by a vinyl layer 22. Over the vinyl layer 22, is the somewhat harder flexible PVC material 24. The layer 24 is used to form the outer surface identified in FIG. 1 as the band-like or annular lower section 3 of the cover. A construction similar to layer 24 can also be used for the collar 1. The upper portion 15 is comprised primarily of only the foam 20 and vinyl 22.

The collar 1 is placed over the top of the mooring buoy 4 with the mooring shackle 5 fitting inside of the collar 1. The mooring pendant 10 can be attached unobstructed to the boat and the buoy with the shackle now being protected by the collar 1. The height of the collar 1 is about the same size as the diameter thereof. To secure the cover to the buoy there may be used an attachment pin 30 that is disposed through the collar and the shackle as illustrated in FIG. 1. The pin 30 may be of many different types and have associated therewith one or more fasteners for holding the pin in place.

In an alternate embodiment of the present invention the cover 2 can also be secured to the buoy below the cover. In that instance a securing line could be attached from one side such as at point 32 down through the chain at location 34 and then back up the other side to the opposite side of the cover at 36. FIG. 1 shows by a dotted line where the securing line is disposed between points 32 and 36. This securing line or tether wraps about the bottom of the mooring ball and as such holds the cover in place on the ball.

As indicated before the main portion of the cover, shown at 15 in FIG. 1 is constructed of a polyethylene foam. Other foam type materials may also be used that are impact resistant. This polyethylene foam, as illustrated in the cross-sectional view of FIG. 2 is also preferably covered with a vinyl layer 22 to provide some level of protection for impacts by the boat on the buoy cover. The vinyl 22 forms a protective coating over the foam 20. The vinyl 22 can be secured in a number of different ways such as by being deposited or it may be in the form of a paint sprayed on the surface of the foam, or a dipping process may be used. The layer 22 may also be formed about the foam core by heat shrinking or other techniques for providing a protective layer over the foam material. As indicated previously, preferably the entire outer surface of the main upper section 15 of the domed cover is protected with an outer vinyl layer.

Regarding the manufacture of the cover of the present invention, the following steps may be used. First, the entire structure is formed of a resilient foam material. Thereafter, a step is provided for covering the entire foam material inside and out with the vinyl material. Thereafter, the more rigid but flexible PVC material is used as a layer for the collar 1 and lower section 3 shown in the drawings, namely the bottom base band of the cover and the top collar.

Figure 3:
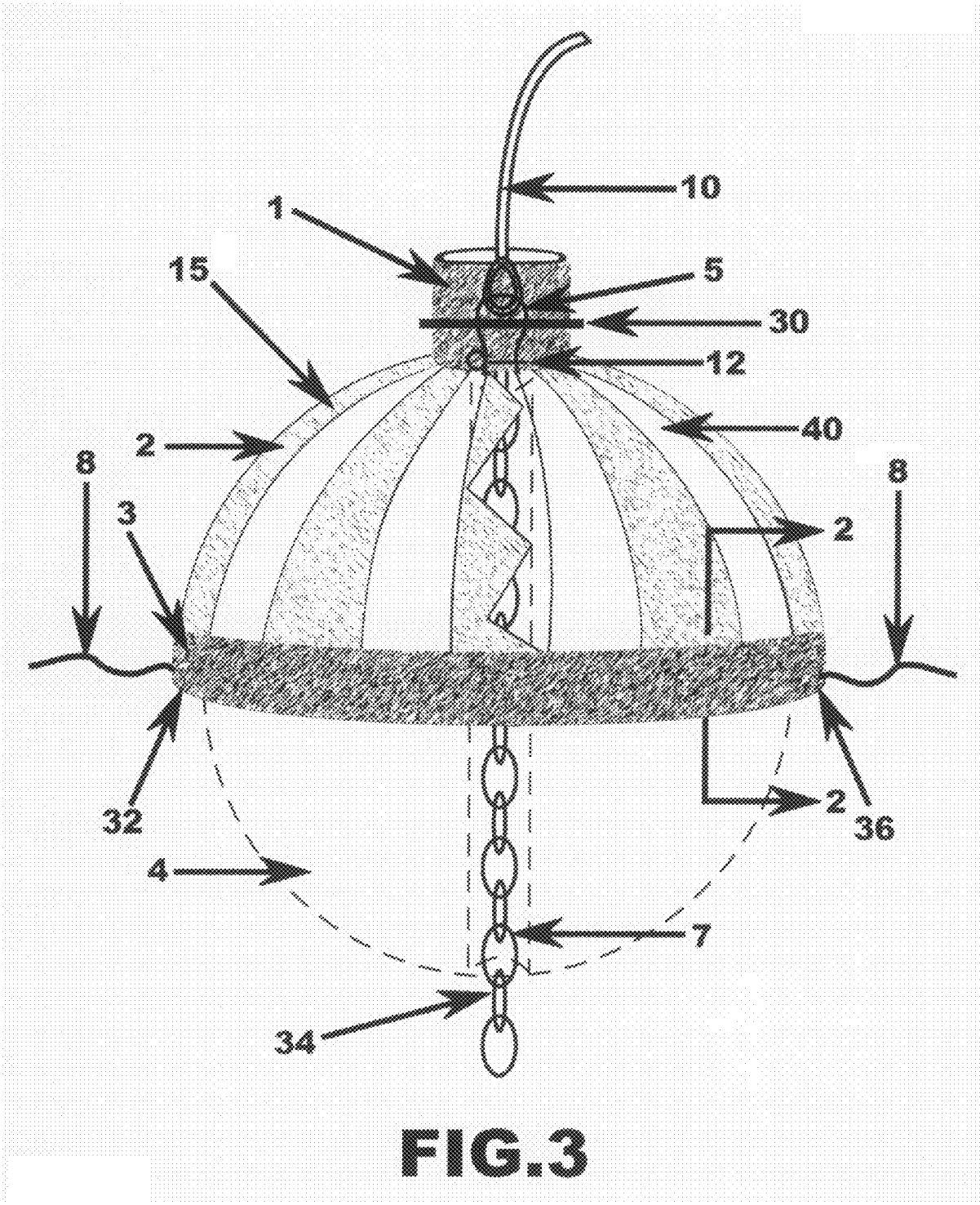
FIG. 3 schematically illustrates another embodiment of the cover of the present invention as attached to a mooring buoy.

Reference is now made to another version shown in FIG. 3. There the same reference characters are used as shown in FIG. 1. The cover is substantially the same as shown in FIG. 1 with the exception that the upper section 15 is now constructed in segments with a void therebetween as shown at 40. The void area is preferably narrower than the segment area so that there is sufficient coverage of the protective material about the buoy. Each segmented area is, as in the first embodiment, of a foam material covered with a vinyl material.

Figure 4:
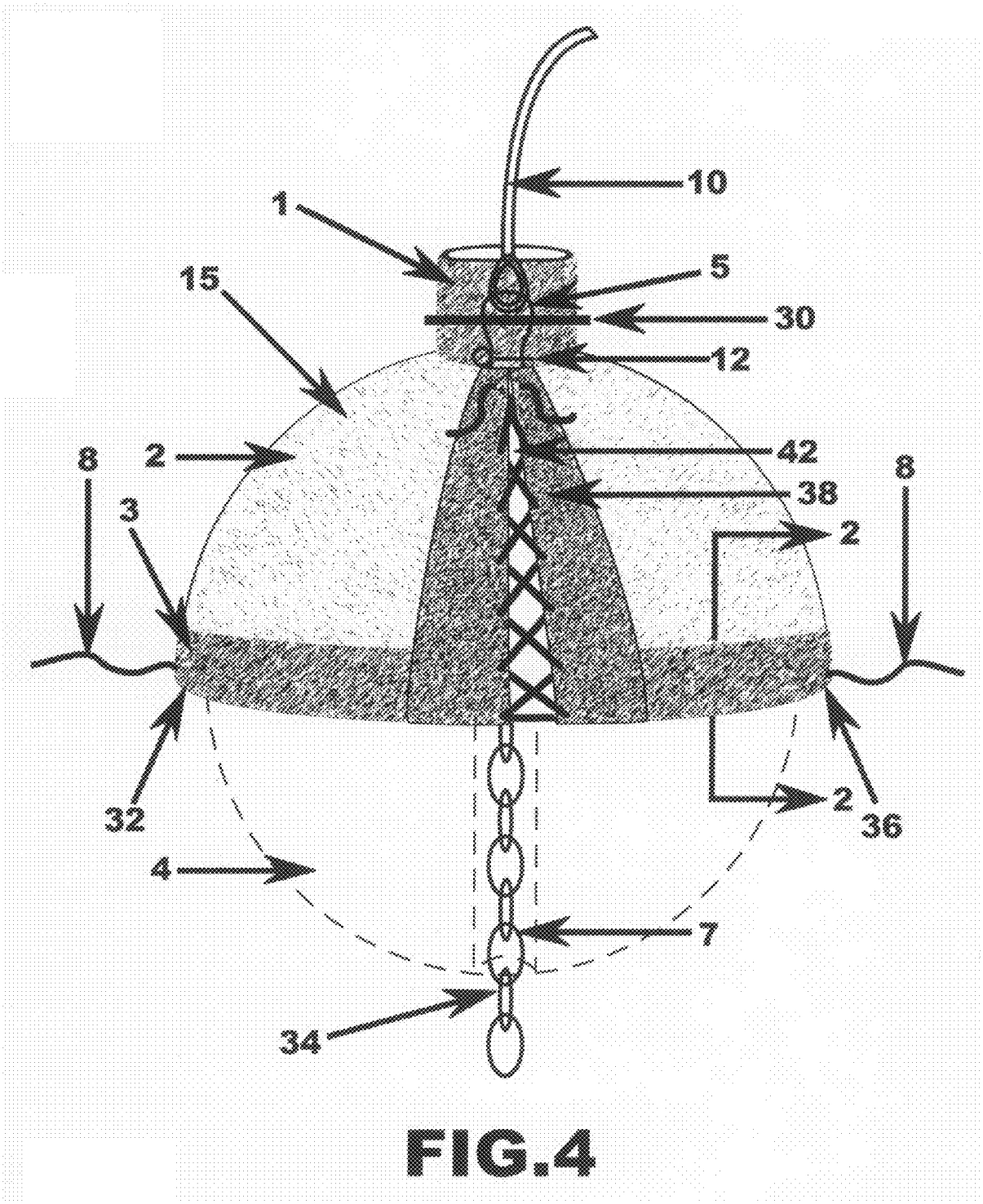
FIG. 4 schematically illustrates still another embodiment of the cover of the present invention as attached to a mooring buoy.

Reference is also now made to still another version shown in FIG. 4. There the same reference characters are used as shown in FIGS. 1 and 3. The cover is substantially the same as shown in FIG. 1 with the exception that the upper section 15 now uses one longitudinal slot 42. This is helpful in fitting the cover to the mooring ball, as many times the balls are of slightly different diameters. With the slot shown in FIG. 4 there is also preferably associated therewith a lacing means 38 that can be used to draw the cover more tightly about the mooring ball.

Thus, in FIG. 4 is shown an alternative embodiment which includes an additional means for adjusting and/or fastening to accommodate variations in size of mooring buoys. The preferred embodiment would have one or more incisions thus allowing the cover to expand to greater size. The lace or adjusting mechanisms 38 would then allow the cover to be secured tightly to the buoy. Additional means of adjustment are possible including but not limited to the use of an elastic material or by alternative means of construction whereby elasticity is planned into the initial design.

In the example shown in FIG. 4 the cover is cut or separated on one or both sides and a lacing system is attached to the foam (FIG. 4 item 38). This lacing system can be constructed using a variety of common materials including but not limited to PVC. In the case of a PVC lacing system the same material used to protect the lower portion (FIG. 4 item 3) could be molded to accommodate this section as well. Holes would be manufactured into the product and a cable would be thread up the side to draw the edges together.

In the construction of the cover of the present invention the different sections may also be fabricated separately and then joined together. For example, the collar and band may be separately formed, such as of a PVC material. Then a mold may be used to form the foam material into the previously constructed PVC pieces so as to fabricate a unitary structure. Interlocking tabs or the like may be used to secure the foam and PVC material together. For example, and with reference to FIG. 2, the PVC layer may be provided with one or more inwardly directed projections. The foam is then injected and forms about these projections to form a secure interlock between the foam material and the PVC material. In still another version of the cover, the separately formed collar and band may be glued to the foam and vinyl substrate.

While preferred embodiments of the invention have now been described, it is understood by those skilled in the art that variations and modifications thereof can be made without departing from the spirit and scope of the present invention. In one alternate embodiment only two layers may be provided including a foam substrate and a harder plastic layer such as a vinyl layer over essentially the entire substrate including the section areas for the collar and annular band.

What is claimed is:

1. A cover for a mooring buoy comprising:

a dome shaped section that is constructed of an impact resistant material and that is formed so as to removably fit with a top part of the mooring buoy; and an upstanding collar section contiguous with said dome shaped section, extending upwardly from a peak of the dome shaped section and extending to cover a shackle that is disposed at the top of the mooring buoy.

2. The cover of claim 1 wherein said dome shaped section is semi-spherical and said collar section is cylindrical.

3. The cover of claim 1 wherein said dome shaped section is constructed of a foam substrate covered by a harder plastic material.

4. The cover of claim 3 wherein said foam substrate is a polyethylene foam material.

5. The cover of claim 1 including an annular section below the dome shaped section forming an annular band that defines the bottom edge of the cover.

6. The cover of claim 5 wherein said collar section and said annular band are formed of a rigid or semi-rigid plastic material.

7. The cover of claim 6 wherein the rigid plastic material is PVC.

8. The cover of claim 1 wherein said collar section is constructed of a rigid plastic material.

9. A cover for a mooring buoy comprising:

a dome shaped section that is constructed of an impact resistant material and that is formed so as to fit with a top part of the mooring buoy; and a collar section contiguous with said dome shaped section and extending to cover a shackle that is disposed at the too of the mooring buoy wherein said dome shaped section is provided in segments separated by void areas.

10. A cover for a mooring buoy comprising:

a dome shaped section that is constructed of an impact resistant material and that is formed so as to fit with a top part of the mooring buoy; and a collar section contiguous with said dome shaped section and extending to cover a shackle that is disposed at the top of the mooring buoy wherein said dome shaped section has at least one elongated slot in combination with lacing means for closing the cover about the mooring buoy.

11. A cover for a mooring buoy comprising:

a dome shaped section that is constructed of an impact resistant material and that is formed so as to fit with a top part of the mooring buoy; and a collar section contiguous with said dome shaned section and extending to cover a shackle that is disposed at the top of the mooring buoy including a securing pin that extends through the collar section and shackle.

12. A mooring buoy cover comprising:

a semi-spherical section that is placed over the top of the mooring buoy and is adapted to substantially conform to the shape of the mooring buoy;

an upstanding cylindrical collar section contiguous with said semi-spherical section and extending to cover a shackle that is disposed at the top of the mooring buoy;

said collar section constructed of a more rigid material than that of said semi-spherical section;

and an annular section that is disposed below the semi-spherical section forming an annular band that defines the bottom edge of the cover.

13. The cover of claim 12 wherein said semi-spherical section is constructed of a foam substrate covered by an outer protective plastic material.

14. The cover of claim 13 wherein said foam substrate is a polyethylene foam material.

15. The cover of claim 12 wherein said collar section and said annular band are formed of a rigid or semi-rigid plastic material.

16. A mooring buoy cover comprising:

a semi-spherical section that is adapted to substantially conform to the shape of the mooning buoy; and a cylindrical collar section contiguous with said semi-spherical section and extending to cover a shackle that is disposed at the top of the mooring buoy;

said collar section constructed of a more rigid material than that of said semi-spherical section;

including an annular section below the semi-spherical section forming an annular band that defines the bottom edge of the cover wherein said collar section and said annular band are formed of a rigid or semi-rigid plastic material wherein the foam material also extends to the collar and annular band sections and is covered at those sections by the rigid plastic material.

17. A mooring buoy cover comprising:

a semi-spherical section that is adapted to substantially conform to the shape of the mooring buoy; and a cylindrical collar section contiguous with said semi-spherical section and extending to cover a shackle that is disposed at the top of the mooring buoy:

said collar section constructed of a more rigid material than that of said semi-spherical section wherein said semi-spherical section is provided in segments separated by void areas.

18. A mooring buoy cover comprising:

a semi-spherical section that is adapted to substantially conform to the shape of the mooring buoy; and a cylindrical collar section contiguous with said semi-spherical section and extending to cover a shackle that is disposed at the top of the mooring buoy;

said collar section constructed of a more rigid material than that of said semi-spherical section wherein said semi-spherical section has at least one elongated slot in combination with lacing means for closing the cover about the mooring buoy.

19. A mooring buoy cover comprising:

a semi-spherical section that is adapted to substantially conform to the shape of the mooring buoy; and a cylindrical collar section contiguous with said semi-spherical section and extending to cover a shackle that is disposed at the top of the mooring buoy;

said collar section constructed of a more rigid material than that of said semi-spherical section including a securing pin that extends through the collar section and shackle.

20. A mooring buoy cover comprising:

a semi-spherical section that is adapted to substantially conform to the shape of the mooring buoy; and a cylindrical collar section contiguous with said semi-spherical section and extending to cover a shackle that is disposed at the top of the mooring buoy;

said collar section constructed of a more rigid material than that of said semi-spherical section including a securing line that extends under the cover.

* * * * *